US008748720B2

(12) United States Patent
Henry

(10) Patent No.: US 8,748,720 B2
(45) Date of Patent: Jun. 10, 2014

(54) SHORT SLIDE TROMBONE WITH FREE FLOATATION BACKSLIDE AND MAGNETIC STOP

(71) Applicant: Jesse Henry, Yucca Valley, CA (US)

(72) Inventor: Jesse Henry, Yucca Valley, CA (US)

( * ) Notice: Subject to any disclaimer, the term of this patent is extended or adjusted under 35 U.S.C. 154(b) by 10 days.

(21) Appl. No.: 13/744,411

(22) Filed: Jan. 17, 2013

(65) Prior Publication Data

US 2014/0013926 A1 Jan. 16, 2014

Related U.S. Application Data

(60) Provisional application No. 61/588,197, filed on Jan. 19, 2012.

(51) Int. Cl.
*G10D 7/10* (2006.01)

(52) U.S. Cl.
USPC ..... 84/395

(58) Field of Classification Search
USPC ..... 84/380 R, 387 R, 388, 389, 390–396
See application file for complete search history.

(56) References Cited

U.S. PATENT DOCUMENTS 4,977,809 A * 12/1990 Staley, Jr. ..... 84/395

* cited by examiner

*Primary Examiner* — Kimberly Lockett

(57) ABSTRACT

The moveable double slide assembly of the comprises a backslide which is connected to the double slide with a link that allows free floatation of the backslide rather than a fixed connection, and thus, the double slide experiences less resistance during travel of the moveable portion.

3 Claims, 11 Drawing Sheets

Detail 1C

Detail 1D

SHORT SLIDE TROMBONE WITH FREE FLOATATION BACKSLIDE AND MAGNETIC STOP

COPYRIGHT RIGHTS

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

FIELD OF THE INVENTION

This invention relates to trombones and wind instruments having a short slide and all trombones with regard to the magnetic stop.

Definitions

The following abbreviations and defined terms apply to the inventions described in this document:

The term "trombone" means a musical wind instrument having a length of stationary tubing and at least one hand slide for changing the pitch by varying the tube lengths thereof. The term "trombone" also mean any trombone including but not limited standard trombone, an alto trombone, a tenor trombone, and/or a bass trombone.

The term "crook" is a curved segment of tubing the forms a semi-circle of approx. 180 degrees and is typically connected to a pair of straight segments of tubing.

The term "slide element" or "hand slide" means a moveable segment of tubing that is substantially U-shaped comprising a pair of substantially straight, parallel tubes joined on one end by a crook . that receive a pair of substantially straight inner tubes of slightly smaller diameter or are received by a pair of substantially straight outer tubes of slightly larger diameter. In other configurations, a "slide" may also mean a combination of one inner tube and one outer tube connected by a crook.

The term "tuning slide" means a moveable slide used for tuning an instrument by correcting the pitch by varying the length of tube of a brass instrument other than a trombone.

The term "hand slide" is a moveable slide element or slide assembly used for playing an trombone or instrument by changing the pitch by varying the tube length of a trombone.

The term "moveable slide assembly" means an assembly of multiple substantially U-shaped segments of tubing that have been joined together and move or slide in unison.

The term "single slide" means a moveable slide element that comprises a two (2) straight, parallel tubes joined at one end by a crook (with or without cross braces) that mate with two (2) stationary tubes.

The term "double slide" means a moveable slide assembly that comprises two (2) slide element that have been joined together and move in unison each slide element having two pair of straight, parallel tubes each pair joined at one end by a crook (with or without cross braces). The term "double slide" is used interchangeably with "short slide."

The term "back slide" means a slide element that is fixed in at least the direction of slide movement and that mates with the ends of the two slide elements that comprise the moveable slide assembly.

The term "free floatation backslide" of the present invention means a back slide the allows movement of the crook and is only restrained in the direction of slide movement.

The term "conventional trombone" is a trombone that utilizes a single hand slide.

The term "short slide trombone" is a trombone that utilizes a double slide to shorten by approximately one-half the distance the slide has move to achieve the same variance in tube length as a conventional trombone. The term "short slide trombone" is used interchangeably with a compact trombone.

SUMMARY OF THE INVENTION

A primary object of the present invention is ensure the pitch of the compact trombone is acceptable to musicians for band and orchestral use. In the literature, the compact trombone designs include a short slide intended primarily to shorten the overall length of the instrument and to save space in front of the musician. For example, U.S. Pat. No. 5,834,666 to Getzen teaches the use of a compact slide that purports to able to be used with existing trombones without adversely changing the pitch. Further, patent '666 to Getzen teaches away from modifying the bell section of the trombone to correct the pitch as presumably required for a compact trombone. However, the trombone as shown by Getzen has crooks and therefore does lengthen the piping within the slide assembly and adversely affect the pitch.

Another object of the present invention is to enable a short slide (aka compact) trombone to move the handslide as easily as a conventional trombone. A short slide (aka compact) trombone has four outer tubes that receive four inner tubes compared to a conventional trombone which has two outer tubes that receive two inner tubes. Thus, the short slide (aka compact) trombone has the potential for more friction if the tubes are not well aligned. In the prior art, four (4) of the tubes are stationary. In comparison, in the preferred embodiment of the present invention, two (2) of the tubes are stationary similar conventional trombone and two (2) of the tubes are not stationary, but rather, these two (2) non-stationary tubes are connected by a crook forming a backslide which is free floating and self-aligning in operation. The backslide is held with a link or tethered to a cross brace between the stationary tubes. The link may in the form of a strut and universal joint enabling these two tubes to be self-aligning.

The prior art illustrates short slide trombones with double slides that have four (4) tubes instead of conventional trombones having a single slide with two (2) tubes. The prior art teaches that all four (4) tubes has a slide portion which is fixed and is a disadvantageous due to the issue of alignment and which the present invention overcomes. For example, U.S. Pat. No. 673,983 to Harrison, U.S. Pat. No. 2,093,993 to Adriani, and later U.S. Pat. No. 4,831,911 to Wanner and U.S. Pat. No. 5,834,666 to Getzen teach the use of a double slide having four (4) stationary tubes to mate with all four (4) tubes of the moveable double slide. Alignment of four (4) tubes is more difficult than alignment of two (2) tubes and is not addressed by the prior art. If the four (4) tubes of the double slide are not extremely well aligned with the four (4) stationary tubes, a double slide can have increased resistance and can tend to bind when in use. The flexibility of the tubing is not sufficient to eliminate the increased resistance due to such fixity, particularly when the moveable double slide is near the closed position. As a consequence, heretofore the short slide trombone in the prior art does not play with same ease as a conventional trombone.

The present invention overcomes this alignment problem by utilizing a free floatation backslide to release the fixity of two (2) of the four (4) tubes at the point of connection of the backslide to the stationary portion of the trombone. The free flotation backslide allows movement in all directions and resists movement only in the direction parallel to the tubes. In so doing, two (2) of the tubes become self-aligning and the double slide short slide trombone with the free floatation backslide plays as easily as the conventional trombone.

Further, the Wanner and Getzen patents teach a double slide with crooks having a small radius bend or tight turn to maintain or minimize the increase in the overall length due to the addition of crooks in the moveable slide assembly compared to a single slide but the crooks having a small radius or tight turn utilized by Wanner and Getzen negatively impact the sound quality. The Wanner and Getzen patents teach away from a double slide that utilizes crooks having an appropriately sized radius as taught by the Adriani patent unless the instrument has a shortened horn and/or bell section specifically designed for use with a double slide trombone. The Wanner patent specifically references the objective of a double slide configuration that can be retrofitted to any trombone and both the Wanner and Getzen patents teach away from a trombone where the bell portion must be specifically designed for the double slide.

Another object of the present invention is provide an alternative finger hold for holding the stationary portion of the tubing without touching the free floatation backslide. Still another object of the invention is to stagger the lengths of the straight tubes of the double slide to ease mating of the four (4) inner tubes insider the outer tubes. For example, first legs of each slide element of the moveable slide assembly may be longer than the second legs of each slide element of the moveable slide assembly to allow mating of the first legs to the stationary tubes of the trombone prior to mating of the second legs to the corresponding legs of the backslide. Further, the second leg of each slide element comprising the moveable slide assembly may be slightly shorter (with or without an alignment ferrule) than the first leg of each slide element comprising the moveably slide assembly allowing for mating of the second legs with the corresponding legs of the backslide one at a time. Still yet another object of the present invention is to aid in manufacturing and finishing the trombone. The free floatation backslide may be separated from the double slide for finishing of the tube surfaces such as plating and polishing which is difficult to achieve a high quality finish in closely spaced tubes. Still yet another object of the invention is the optional use of a magnetic stop to keep the double slide assembly from traveling so far to separate from the trombone.

DETAILED DESCRIPTION OF THE INVENTION

Figure 1:
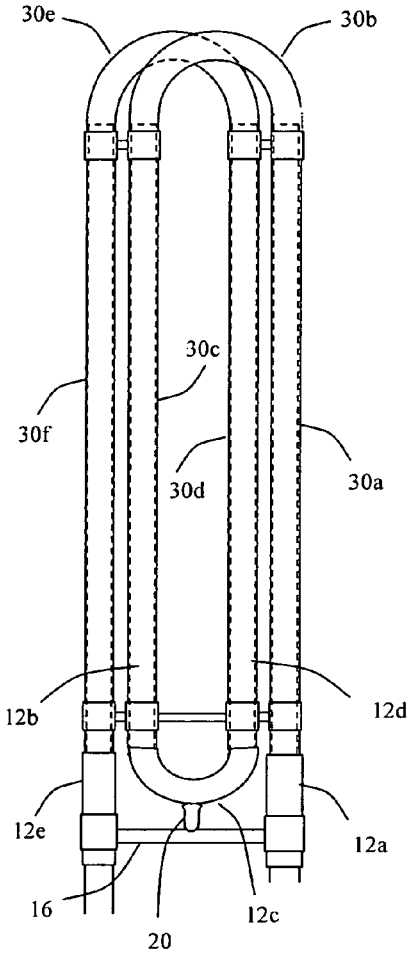
FIG. 1 (Prior Art)
FIG. 1 is a partial side view of the double slide in the prior art having all four (4) tubes of the double slide mating with four (4) stationary tubes.

With reference to FIG. 1, a double slide in prior art is depicted in the drawing and relevant elements of the prior art are referenced by numerals. Of particular relevance, the two inner tubes 12*b* and 12*d* are joined by crook 12*c* and a rigid element 20 firmly holds the crook 12*c* to a cross beam 16 between stationary tubing 12*a* and 12*e*.

Figure 2:
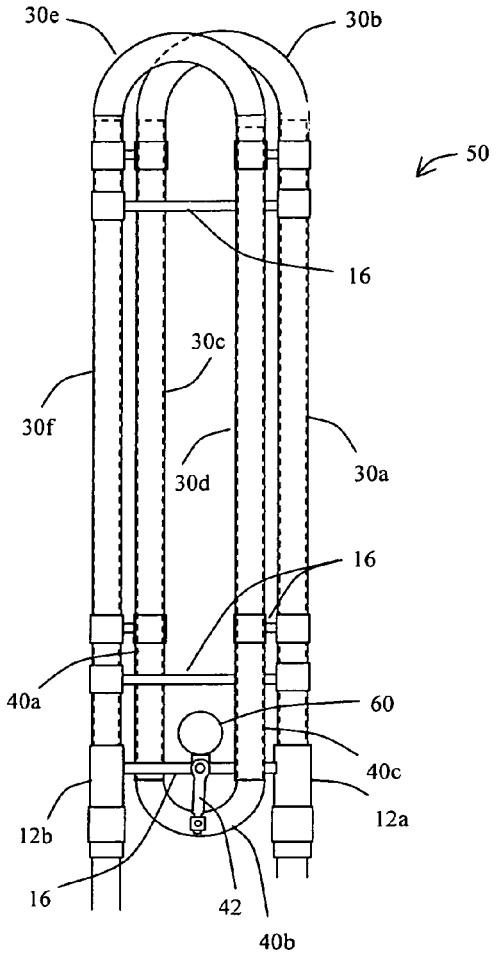
FIG. 2 is a partial side view of one embodiment of the present invention having two (2) tubes of the moveable double slide mating with two (2) stationary tubes and two (2) tubes of the double slide mating with two (2) tubes of the free floatation backslide.
Figure 2A:
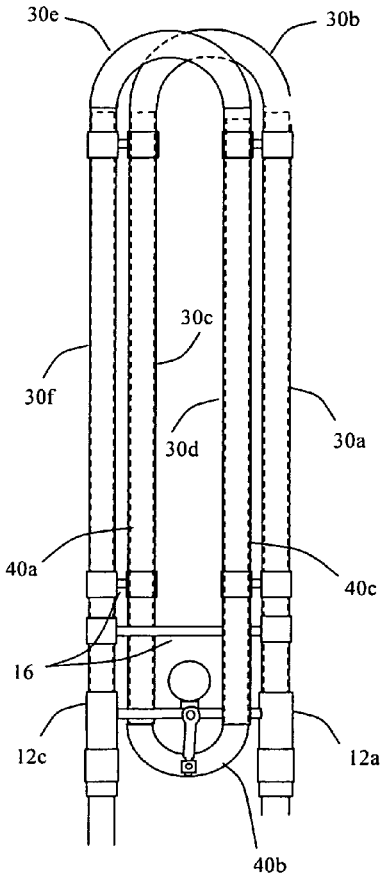
FIG. 2A, 2B, 2C, and 2D are partial side views of alternative embodiments of the present invention.
Figure 2B:
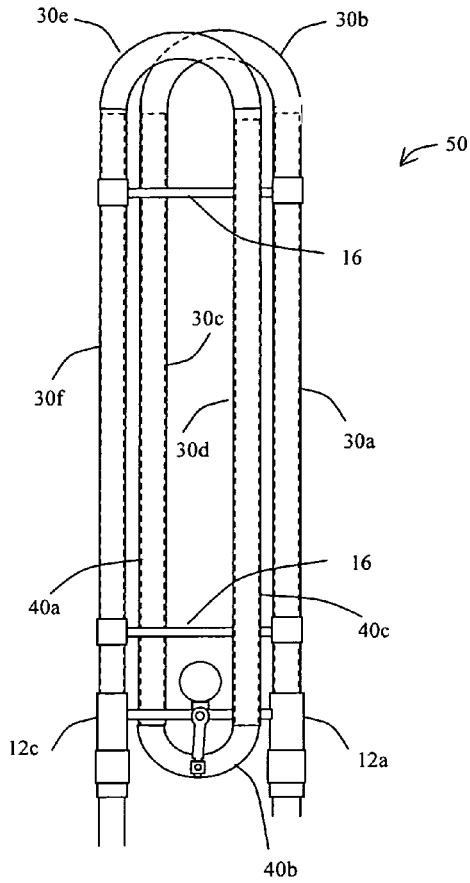
Figure 2C:
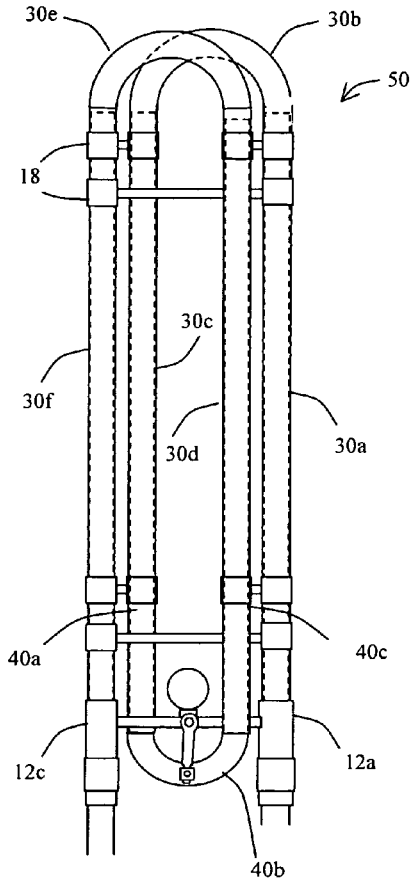
Figure 2D:
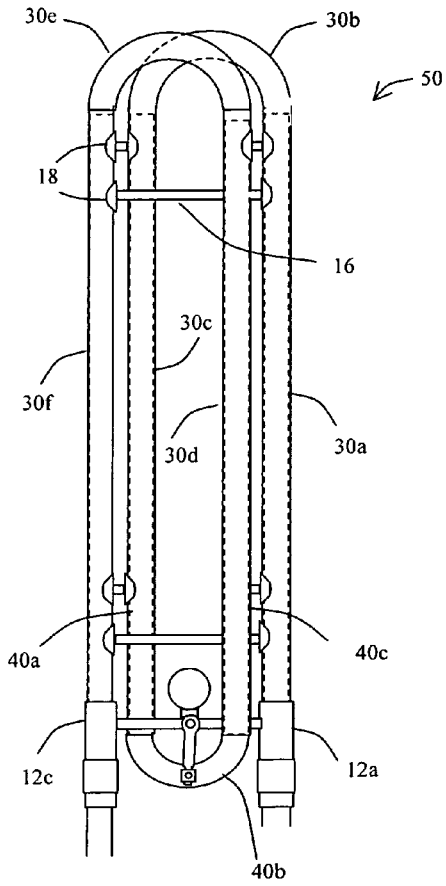

With reference to FIGS. 2 through 7, various embodiments of the double slide assembly 50 of the present invention are depicted in the drawings and elements of the present invention are referenced by numerals. The two inner tubes 40*a* and 40*c* are joined by crook 40*b* and are held in position by a flexible connection between the crook 40*b* and a cross brace 16 nearest the position where the handslide is closed. Each of the inner tubes has a corresponding outer tube. For example, inner tube 12*a* mates with outer tube 30*a*, inner tube 40*a* mates with outer tube 30*c*, inner tube 40*c* mates with inner tube 30*d*, and inner tube 12*b* mates with outer tube 30*f*. Outer tubes 30*a* and 30*c* are joined by crook 30*b* and outer tubes 30*d* and 30*f* are joined by crook 30*b*. In FIGS. 2A through 2D, the various embodiments of the double slide assembly 50 are shown. FIGS. 2A and 2B show variations in the cross bases 16. FIGS. 2C and 2D show variations in the ferrules 18 and the like used to connect the cross braces between 30*a* and 30*f* and/or between 30*a* and 30*d* and/or between 30*c* and 30*f*.

Figure 3:
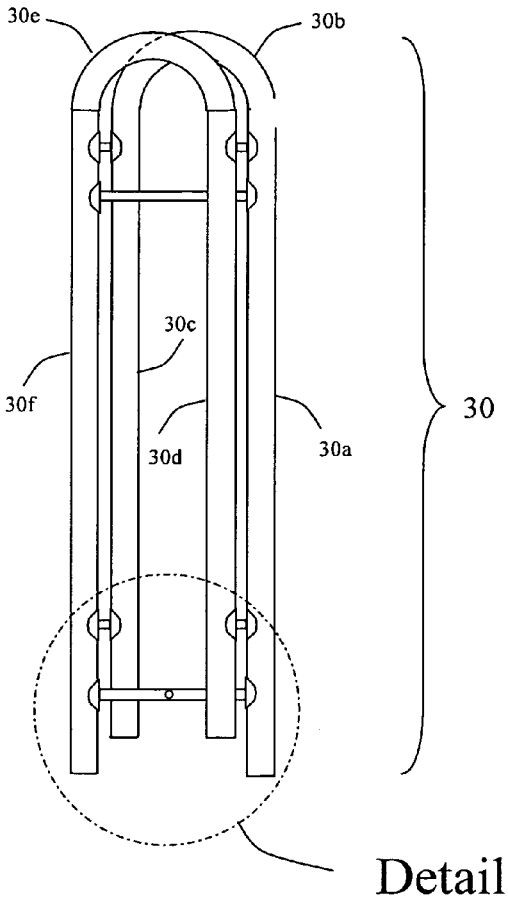
FIG. 3 is a side view of the moveable double slide of the present invention without the free floatation backslide.

In FIG. 3, the double slide 30 of the present invention is shown. The double slide includes four (4) outer tubes (30*a*, 30*c*, 30*d*, and 30*f*) for receiving four (4) inner tubes (12*a*, 40*a*, 40*c*, 12*c*). Based on the above discussion, a person skilled in the art can determine the number and location of cross brace that may be necessary for mechanical integrity, tonal quality, and a appropriate grip on the handslide. If polishing is This double slide 30 is plated or otherwise finished as well as polished prior to assembly with the free floatation backslide 40 into the double slide assembly 50.

Figure 4:
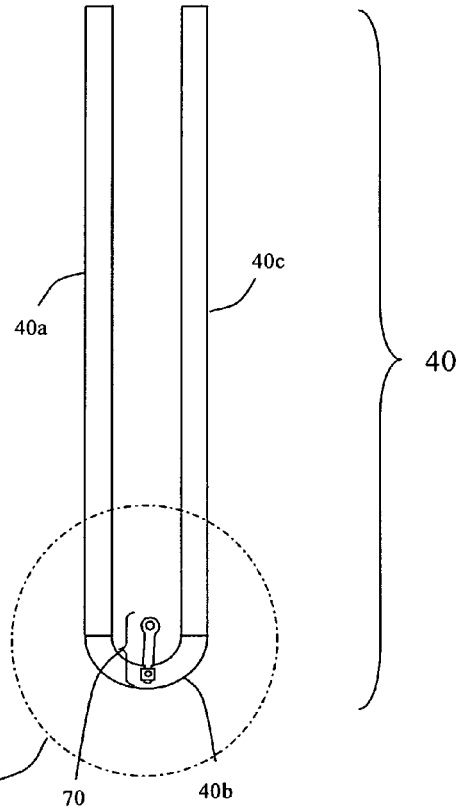
FIG. 4 is a side view of the free floatation backslide and the flexible connection to the cross brace between stationary tubes.

In FIG. 4, the free floatation backslide 40 of the present invention is shown. Consistent with its name, the free floatation backslide is free floating and only connected with a flexible arm to a cross brace 16 between the stationary tubes 12*a* and 12*c*. Specifically, the crook 40*b* may rotate and translate in any direction without resistance except translation in resisted in the longitudinal direction or the direction of slide travel. This free rotation and translation allows the straight tube segments comprising the free floatation backslide to self-align. In one embodiment, the flexible arm comprises several components which are detailed in FIGS. 7A and 7B. It will be appreciated that a person skilled in the art can build the flexible arm in various configurations and from various materials. For example, the flexible arm may comprise a strut with a universal joint at one end as shown in the FIGS. 7A and 7B.

Figure 5:
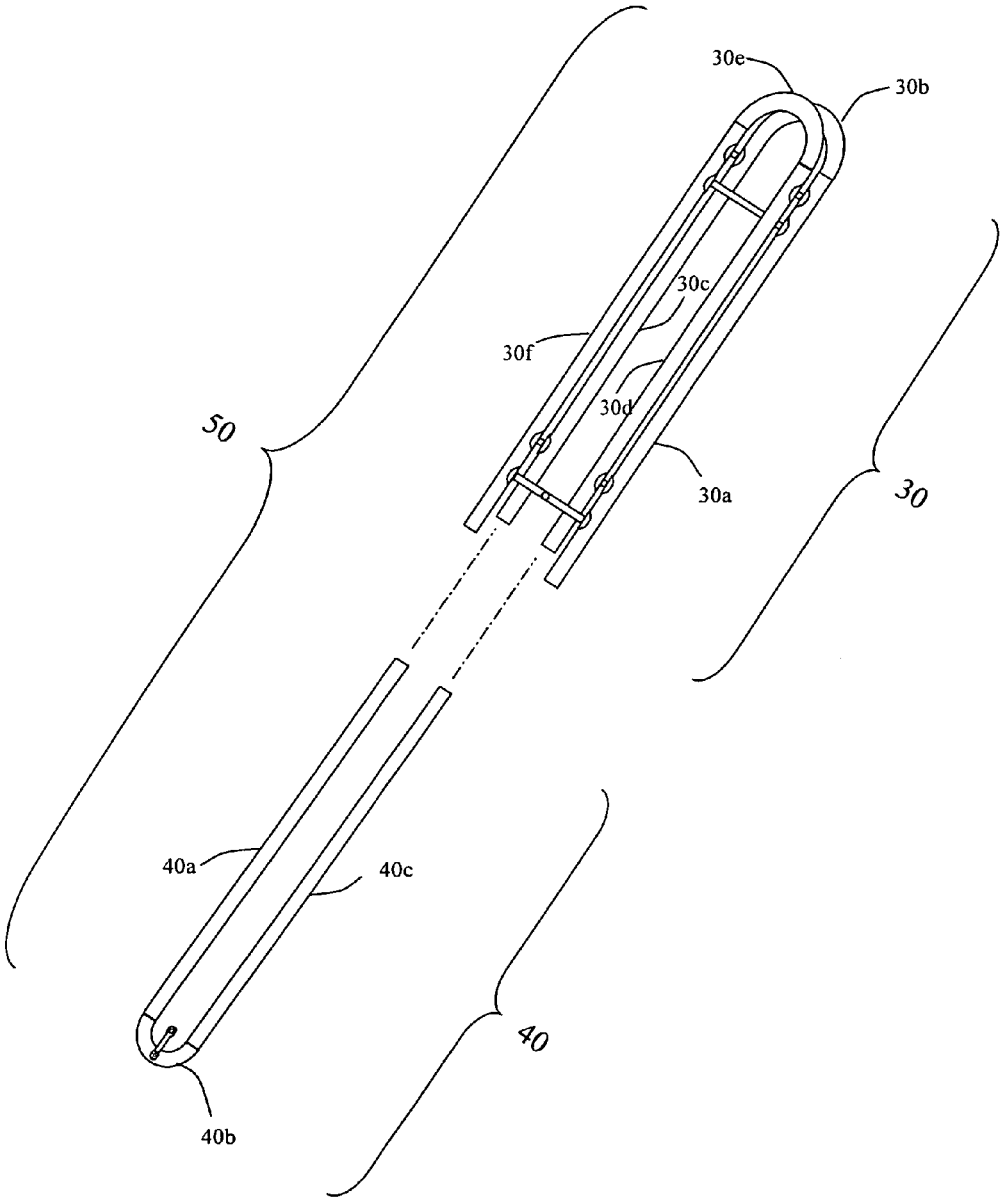
FIG. 5 is an exploded view of the slide assembly of the present invention.

In FIG. 5, an exploded view of the double slide assembly 50 of the present invention is shown. The double slide assembly is a combination of double slide 30 and the free floatation slide 40. The ends of the tubes 30*a*, 30*c*,30*d*, and 30*f* of the double slide 30 mate with two (2) stationary tubes 12*a* and 12*c* and two tubes 40*c* and 40*c* of the backslide.

Figure 6:
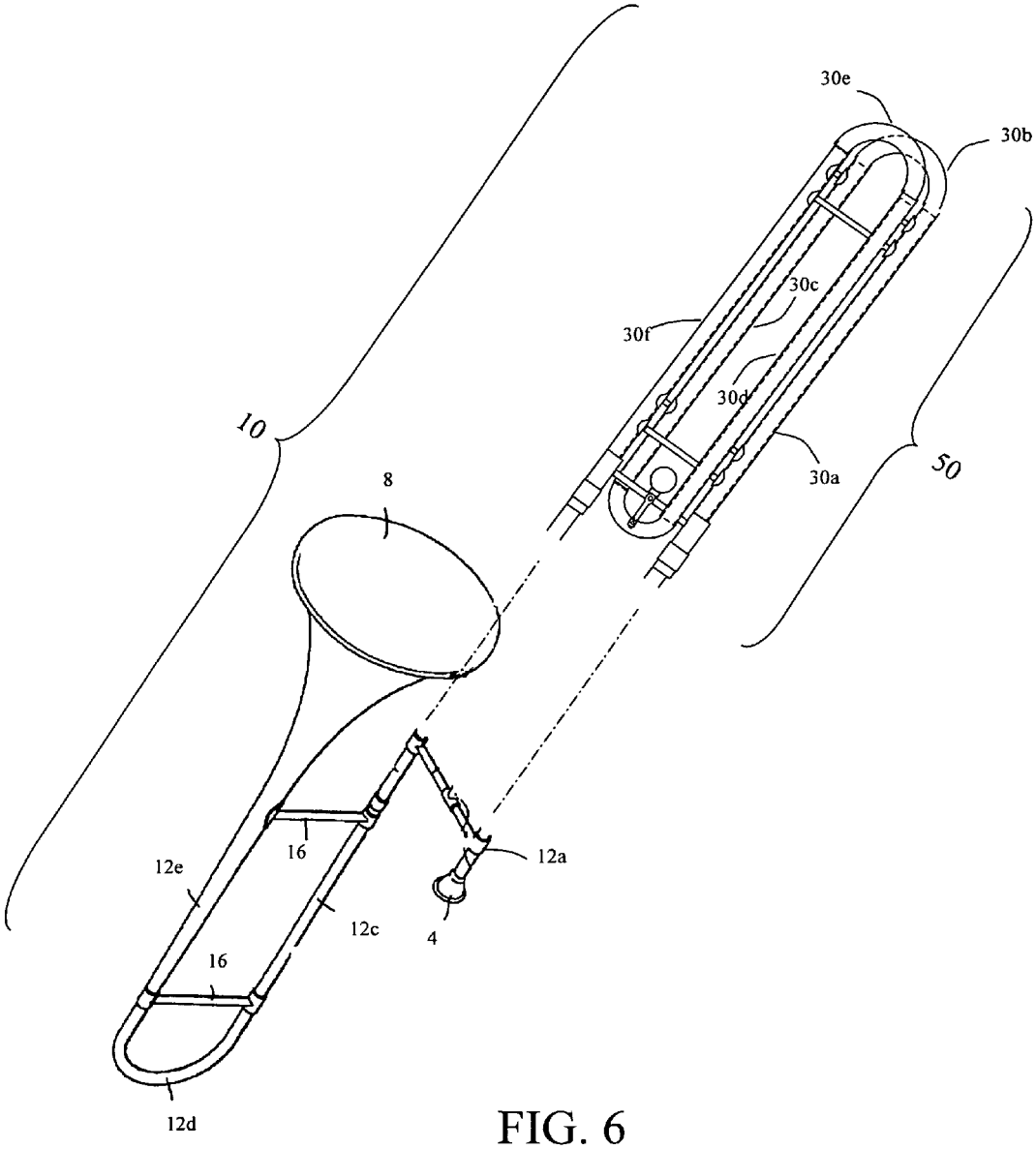
FIG. 6 is an exploded view of the trombone of the present invention.

In FIG. 6, an exploded view of the trombone 10 of the present invention is shown. The trombone is a combination of the moveable double slide 50 and tubing 12*c*, 12*d*, and 12*e* as well as mouthpiece 4 and bell 8.

Figure 7A:
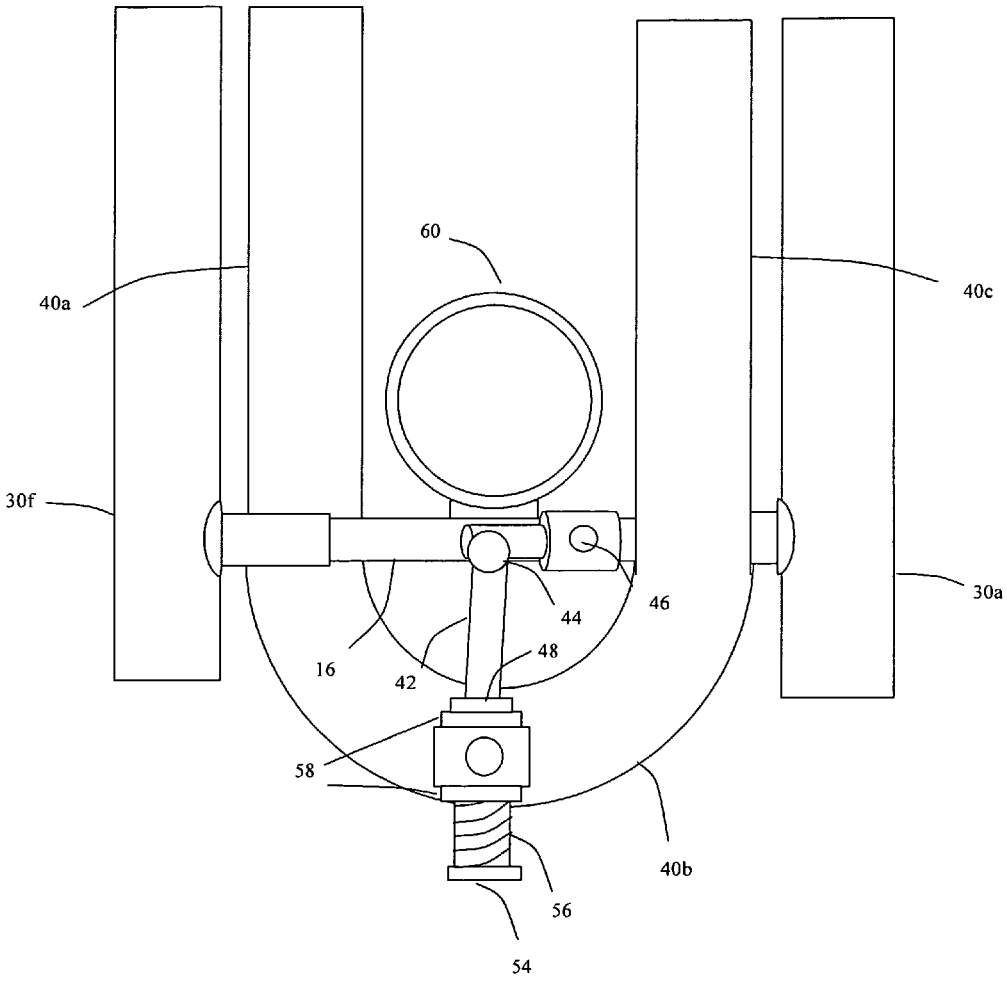
FIGS. 7A ,7B, 7C, and 7D are detailed views of alternate embodiments of the free floatation slide and its flexible connection to the cross brace between the stationary tubes.
Figure 7B:
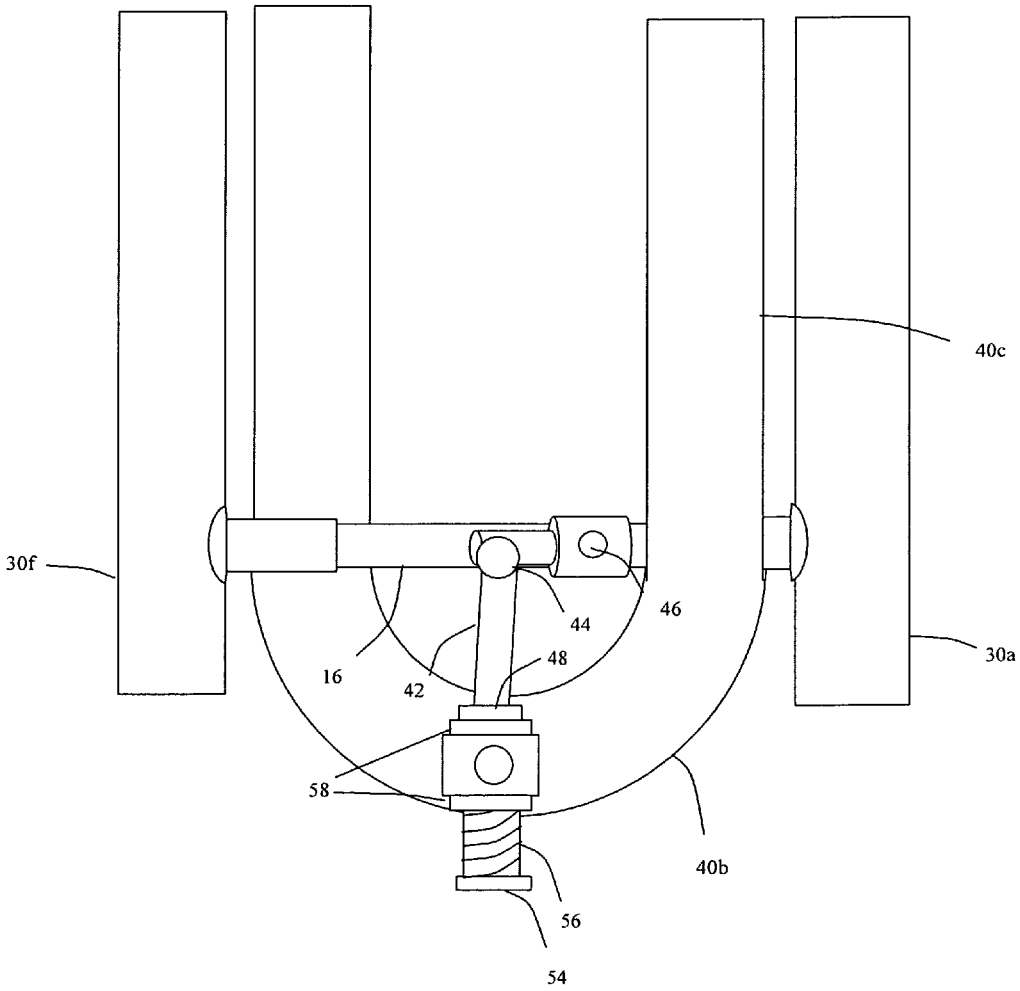
Figure 7C:
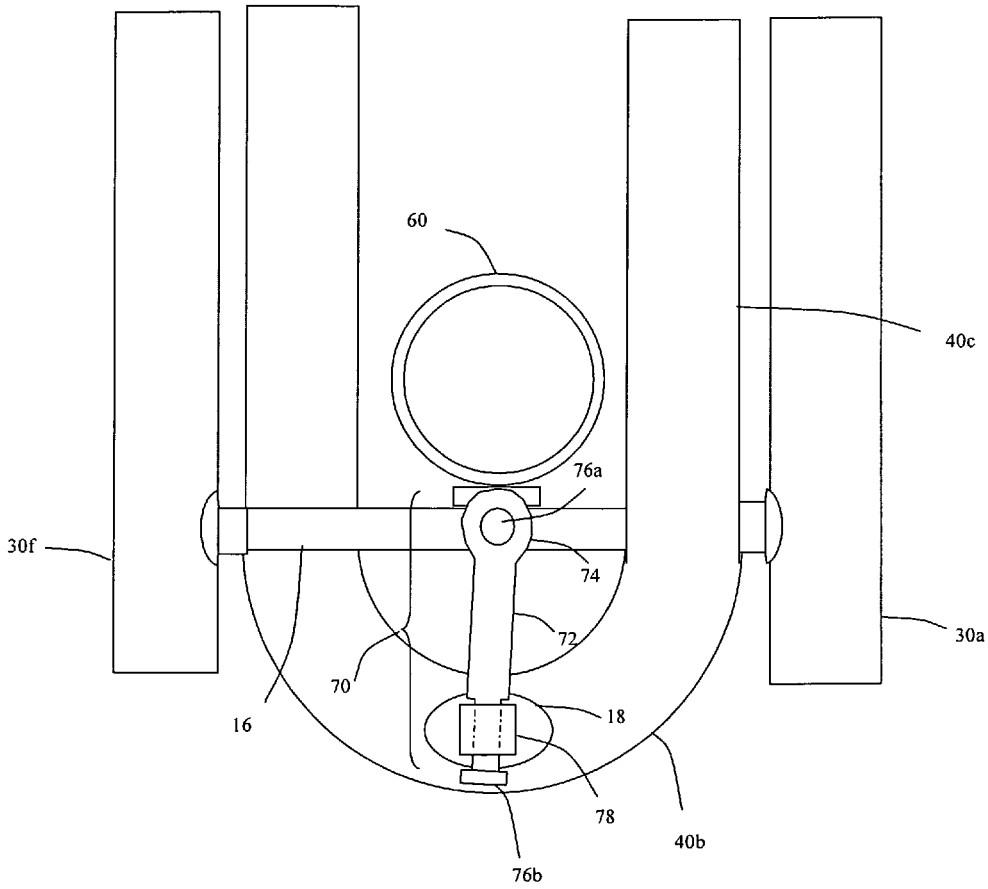

With reference to FIGS. 7A through 7D, the alternative details in FIGS. 7A and 7C include a finger ring 60 as element to hold the double slide assembly 50 (comprising the free floatable backslide 40 attached to the double slide 30. The alternative details in FIGS. 7B and 7D do not include the finger ring because it is not essential element of the invention and the double slide can be held with various structural elements mounted to the double slide assembly 50. With reference to FIGS. 7A and 7B, the trombone the free floatation backslide 40 is flexibly connected to the cross brace 16 by a linkage 70 comprising a strut 42 with a universal joint 44 and connected to a link or strut 46 by a swivel or hinged joint 48 to allow movement of the free floatation backslide in all directions and is restrained only in the direction of the double slide movement. In some embodiments, the strut 42 is fully restrained by a fastener in the direction of the double slide movement at its point of connection to the free flotation backslide 40. In other embodiments, the strut 42 may be restrained in the direction of the double slide movement by a fastener in combination with a piston, spring or other resilient means with or without a dampener. For example, rather than the backslide having a fixed connection in the direction of slide movement, a compression spring 56 allows movement of the slide in the direction of slide movement but resists substantial movement of the slide and is retains by a collar 54. For example, in one embodiment, the compression spring is of the type used for valve springs in pistons of other brass or wind instruments. Further, there may be one or more resilient washers 58 to dampen the movement of the spring. Thus, in another embodiment, the resilient washers 58 are cork similar to washers used for valve seats in pistons of other wind instruments.

Figure 7D:
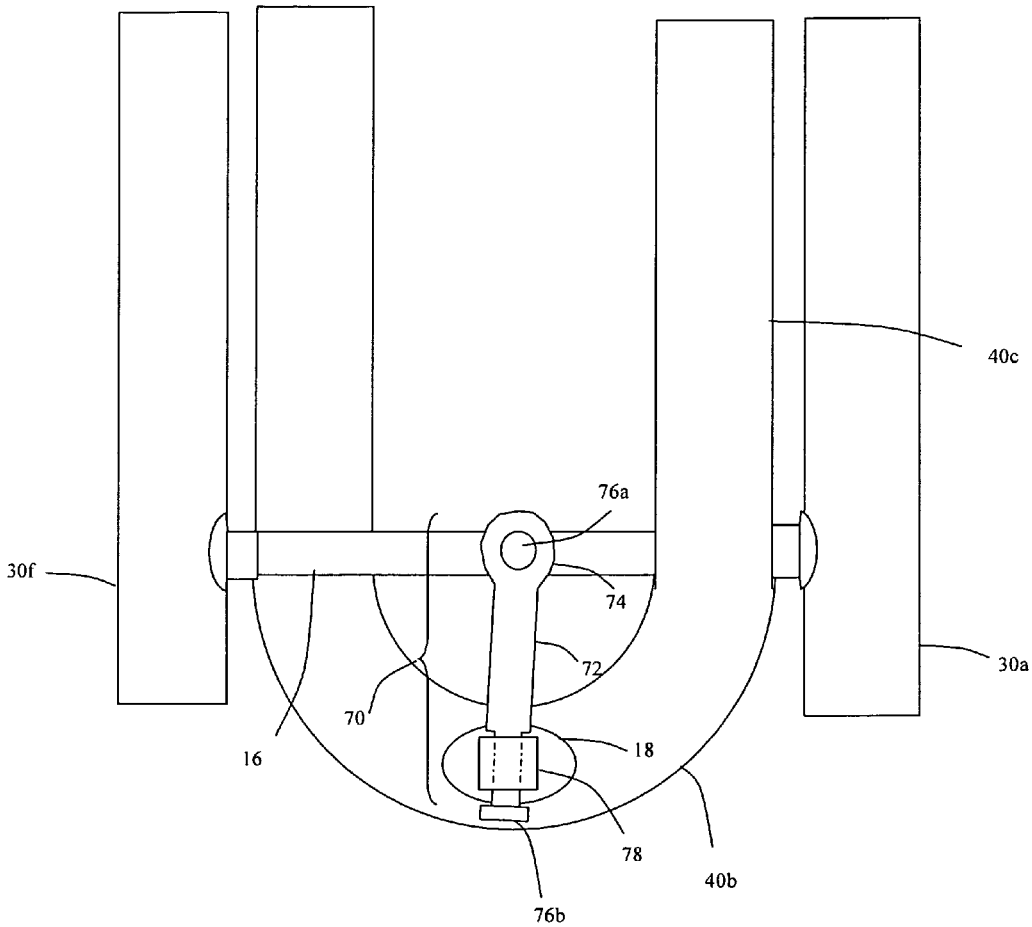
Figure 8:
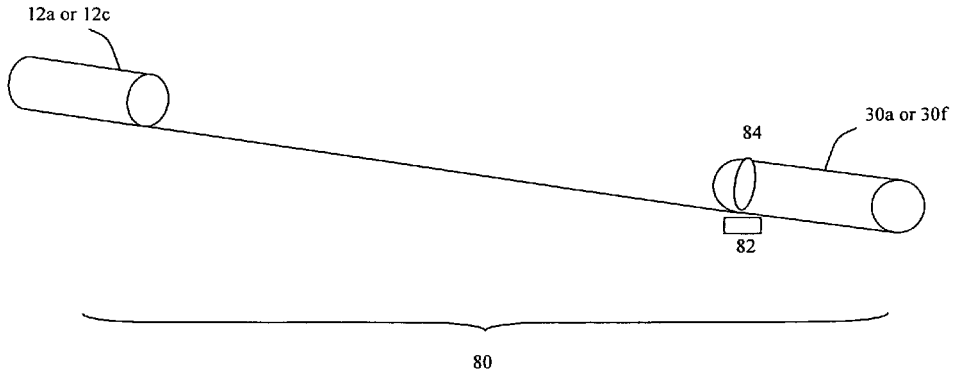
FIG. 8 is a partial side view of an optional magnetic stop assembly installed on a trombone.

In FIGS. 7C and 7D, in the preferred embodiment of the present invention, the free floatation backslide 40 is flexibly connected to the cross brace 16 by a linkage 70 which comprises a ball link 72 having at one end a ball joint 74 of the type manufactured by Dubbe (e.g. model #2262) with 4-40 screws or screws and nuts of appropriate size for each end provided by the manufacturer or readily available. At one end of the ball link, a first screw 76*a* passes through the ball joint and attaches to the cross brace. At the other end of ball link, a second screw 76*b* passes through a block 78 attached to the crook 40*b* and threads into the end of the ball link 72. The block 78 may be attached to the crook 40*b* by solder or other means with or without a ferrule 18 as reinforcement. In various embodiments, screws can be positioned or secured with nuts.

In one embodiment, the free floatation backslide is removably attached to the trombone 10 by holding a leg of the universal joint with a set screw 46. In other embodiments, the free floatation backslide is removably attached to the trombone by clamping a leg of the universal joint to the trombone. A person skilled in the art can provide a clamping means. In still other embodiments, the connecting means for the free floatation backslide 40 to the cross brace 16 is even simpler. For example, a torsion spring can be used in lieu of the strut and universal joint to suspend the free floatation backslide. In another example, even simpler still is use of a tether or strap to tie the free floatation backslide 40 to the cross brace 16.

In at least one embodiment of the present invention, a finger ring 60 mounted to the cross brace 16 to facilitate gripping of the double slide 30 without touching the free floatation slide 40.

In at least one embodiment, a magnetic stop assembly 80 is added to the trombone to prevent the double slide assembly 50 from traveling so far as to separate from the trombone. The magnetic stop assembly 80 is a metal rod or stiff wire or material of similar stiffness. One end of the magnetic stop assembly 80 is clamped or attached by a fastening means to at least one outer tube 12*a* or 12*c* of the trombone. The other end of the magnetic stop assembly includes a magnet at a predetermined distance from the other end corresponding to the length of travel of the double slide assembly 50. In operation, the magnet is attracted to and removably attaches to a metallic object 84 that is clamped or attached to an outer tube of the double slide assembly 50. The metallic object 84 may be removeably attached to the outer tube such as a metal hose clamp.

In the preferred embodiment, the invention teaches the addition of two crooks which adds to the overall length of tubing in the trombone. In the preferred embodiment, to obtain proper pitch, the invention teaches the reduction in the length of the tubing in the bell section to to compensate. In other embodiments, a tuning slide or valve may be used by a person skilled in the art.

In operation, the free floatation backslide 40 is suspended in adjacent position between the legs of moveable double slide 30 and does not hinder the movement of the double slide. In operation, with regard to the invention shown in FIGS. 2 and 5, the musician has the benefits of the compact trombone with a double slide since the slide does not have to be moved as far. Similar to other double slides, the wind path from the mouthpiece 4 follows the stationary inner tube 12*a* to outer slide 30*a* to crook 30*b* to outer slide 30*c* to inner slide 40*a* to crook 40*b* to inner slide 40*c* to crook 30*e* to outer slide 30*f* to stationary tube 12*c* to crook 12*d* to stationary tube 12*f* to bell 8.

In one embodiment, a magnetic stop assembly 80 is added to the trombone to prevent the double slide from traveling so far as to separate from the trombone.

Other embodiments of the present invention include a portion or all of the musical instrument constructed from alternative materials. For example, the tubing and cross braces may be made out of fiberglass and injection molded plastic, respectively. In another example, certain components and materials may be constructed from brass and other components may be constructed from plastic.

From the foregoing it will be appreciated that although specific embodiments of the invention have been described herein for purposes of illustration, various modifications may be made without deviating from the spirit and scope of the invention. For example, the invention could be applied to other musical instruments that currently exist or may be constructed in the future. Accordingly, the invention should be broadly construed and should not be limited to the invention as claimed.

What is claimed is:

1. A trombone which changes pitch by varying the tube length thereof comprising:

a pair of stationary tubes disposed spaced apart from each other in a first plane, each of said tubes of said first pair having a first end and a second end;

a first substantially U-shaped slide element, said slide element having a pair of non-stationary tubes disposed spaced apart from each other in a second plane, each of said tubes of said pair being a having a first end and a second end, each of said pair of legs being joined on said first ends thereof by a crook, said pair of non-stationary tubes being closer to each other than said pair of stationary tubes are to each other;

means for coupling said first ends of said pair of non-stationary tubes to each other, said coupling means being disposed substantially in said second plane;

a bell for affixment to said first end of one of said pair of stationary tubes;

a mouth piece for affixment to said first end of the other of said pair of stationary tubes;

a moveble slide assembly, said moveable slide assembly including a second and a third substantially U-shaped slide elements, said second and said third slide elements each having a pair of legs, each of said legs each having a first and a second end, each of said pair of legs being joined on said first ends thereof by a crook, said second ends of each of said pairs of adjacent legs being dimensioned for slideably engaging a corresponding one of said second ends of said pair of stationary tubes and said pair of non-stationary tubes such that said second ends of said first pair of said adjacent legs slidably engage, respectively, one of said second ends of said first pair of said stationary tubes and one of said second ends of said pair of non-stationary tubes, said second ends of said second pair of said adjacent legs slidably engaging, respectively, the other of said second ends of said pair of said stationary tubes and the other of said second ends of said pair of said non-stationary tubes, said first and said second pairs of substantially U-shaped slide tube members being joined together for simultaneous movement; and a said non-stationary tubes restrained in the direction of the slide by a flexible connection between the crook and a cross brace, said flexible connection allowing lateral movement of the first substantially U-shaped slide element.

2. The trombone of claim 1 wherein the flexible connection comprises a link, having a first end and a second end, between the first substantially U-shaped slide element and a stationary structure adjacent to the crook of the first substantially U-shaped slide element with at least one universal joint at either the first end or second end of the flexible connection wherein the first end of the flexible connection is mounted to the first substantially U-shaped slide element and the second end of the flexible connection is mounted to a stationary structure adjacent to the first substantially U-shaped slide element, said stationary structure being a cross brace between the pair of stationary tubes.

3. The trombone of claim 1 wherein the non-stationary tubes are restrained by a structural element having one end removably attached to at least one stationary tube and a magnet at the other end wherein a metallic object is removeably attached to the non-stationary tubes will stop travel of the non-stationary tubes when the magnetic object is in close proximity to the magnet.

* * * * *